US007645548B2

(12) United States Patent
De Jong et al.

(10) Patent No.: US 7,645,548 B2
(45) Date of Patent: Jan. 12, 2010

(54) PHOTORECEPTOR OVERCOAT LAYER MASKING AGENT

(75) Inventors: Kathy L. De Jong, Oakville (CA); Hany Aziz, Oakville (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 353 days.

(21) Appl. No.: 11/556,815

(22) Filed: Nov. 6, 2006

(65) Prior Publication Data

US 2008/0107980 A1 May 8, 2008

(51) Int. Cl.
*G03G 5/06* (2006.01)

(52) U.S. Cl. ..... 430/58.05; 430/76; 430/132

(58) Field of Classification Search ..... 430/58.05, 430/76, 132

See application file for complete search history.

(56) References Cited

U.S. PATENT DOCUMENTS

| | | | | |
|---|---|---|---|---|
| 3,121,066 | A | 2/1964 | Horst | |
| 4,050,935 | A | 9/1977 | Limburg et al. | |
| 4,224,422 | A * | 9/1980 | Rude et al. | 525/454 |
| 4,281,054 | A | 7/1981 | Horgan et al. | |
| 4,297,425 | A | 10/1981 | Pai et al. | |
| 4,457,994 | A | 7/1984 | Pai et al. | |
| 4,503,161 | A * | 3/1985 | Korbel et al. | 502/159 |
| 4,599,286 | A | 7/1986 | Limburg et al. | |
| 4,871,634 | A | 10/1989 | Limburg et al. | |
| 5,368,967 | A | 11/1994 | Schank et al. | |
| 5,418,107 | A | 5/1995 | Nealey et al. | |
| 5,681,679 | A | 10/1997 | Schank et al. | |
| 5,702,854 | A | 12/1997 | Schank et al. | |
| 5,709,974 | A | 1/1998 | Yuh et al. | |
| 5,976,744 | A | 11/1999 | Fuller et al. | |
| 6,004,709 | A | 12/1999 | Renfer et al. | |
| 2006/0105264 | A1 * | 5/2006 | Dinh et al. | 430/132 |

OTHER PUBLICATIONS 11556815-292316 EIC-Search, STIC CAS search on Apr. 21, 2009.*
U.S. Appl. No. 11/275,546, Qi et al., filed Jan. 13, 2006.
U.S. Appl. No. 11/234,275, Dinh et al., filed Sep. 26, 2005.
U.S. Appl. No. 11/295,134, Yanus et al., filed Dec. 13, 2005.

* cited by examiner

*Primary Examiner*—John L Goodrow
(74) *Attorney, Agent, or Firm*—Oliff & Berridge, PLC

(57) ABSTRACT

A coating composition having a polymer resin composition containing at lest an acid catalyst and a masking agent, wherein the masking agent is selected from the group consisting of compound A, compound B, and the acylated derivatives of compound A, where compound A is given by the structural formula (I):

(I)

where X represents a substituent selected from the group consisting of —OR and —NR'R", wherein R, R', and R" each independently represent a hydrogen atom or a hydrocarbyl group; and compound B is given by the structural formula (II):

(II)

where Y and Z independently represent —OH or —$NH_2$.

26 Claims, No Drawings

PHOTORECEPTOR OVERCOAT LAYER MASKING AGENT

TECHNICAL FIELD

This disclosure is generally directed to electrophotographic imaging members and, more specifically, to layered photoreceptor structures with an improved overcoat layer. In particular, this disclosure relates to electrophotographic imaging members with an improved overcoat layer comprising a novel masking agent. This disclosure also relates to processes for making and using the imaging members.

RELATED APPLICATIONS

Copending U.S. patent application Ser. No. 11/275,546 filed Jan. 13, 2006, discloses and electrophotographic imaging member comprising a substrate, a charge generating layer, a charge transport layer, and an overcoating layer, said overcoating layer comprising a cured film formed from a film-forming resin composition comprising at least a melamine compound, a polyol, and a charge transport compound, wherein the charge transport compound is represented by:

$$Q\text{-}[L\text{-}OH]_n$$

wherein Q represents a charge transport component, L represents a divalent linkage group, and n represents a number of repeating segments or groups.

Copending U.S. patent application Ser. No. 11/234,275 filed Sep. 26, 2005, discloses an electrophotographic imaging member comprising a substrate, a charge generating layer, a charge transport layer, and an overcoating layer, said overcoating layer comprising a cured polyester polyol or cured acrylated polyol film-forming resin and a charge transport material.

Copending U.S. patent application Ser. No. 11/295,134 filed Dec. 13, 2005, discloses an electrophotographic imaging member comprising a substrate, a charge generating layer, a charge transport layer, and an overcoating layer, said overcoating layer comprising a terphenyl arylamine dissolved or molecularly dispersed in a polymer binder.

The appropriate components and process aspects of the foregoing, such as the imaging member composition, components and methods, may be selected for the present disclosure in embodiments thereof. The entire discloses of the above-mentioned applications are totally incorporated herein by reference.

REFERENCES

Various overcoats employing alcohol soluble polyamides have been proposed in the prior art. One of the earliest ones is an overcoat comprising an alcohol soluble polyamide without any methyl methoxy groups (Elvamide) containing N,N'-diphenyl-N,N'-bis(3-hydroxyphenyl)-[1,1'-biphenyl]-4,4'-diamine. This overcoat is described in U.S. Pat. No. 5,368,967, the entire disclosure thereof being incorporated herein by reference. Although this overcoat had very low wear rates in machines employing corotrons for charging, the wear rates where higher in machines employing bias charging rolls (BCR). A crosslinked polyamide overcoat overcame this shortcoming. This overcoat comprised a crosslinked polyamide (e.g. Luckamide) containing N,N'-diphenyl-N,N'-bis(3-hydroxyphenyl)-[1,1'-biphenyl]-4,4'-diamine. In order to achieve crosslinking of the polyamide polymer, Luckamide, having methyl methoxy groups, was employed along with a catalyst such as oxalic acid. This tough overcoat is described in U.S. Pat. No. 5,702,854, the entire disclosure thereof being incorporated herein by reference. With this overcoat, very low wear rates were obtained in machines employing bias charging rolls (BCR) and Bias transfer Rolls (BTR). Durable photoreceptor overcoatings containing crosslinked polyamide (e.g. Luckamide) containing N,N'-diphenyl-N,N'-bis(3-hydroxyphenyl)-[1,1'-biphenyl]-4,4'-diamine (DHTBD) (Luckamide-DHTBD) have been prepared using oxalic acid and trioxane to improve photoreceptor life by at least a factor of 3 to 4. Such improvement in the BCR wear resistance involved crosslinking of Luckamide under heat treatment, e.g. 110° C.-120° C. for 30 minutes. However, adhesion of this overcoat to certain photoreceptor charge transport layers, containing certain polycarbonates (e.g., Z-type 300) and charge transport materials (e.g., bis-N,N-(3,4-dimethylphenyl)-N-(4-biphenyl)amine and N,N'-diphenyl-N,N'-bis(3methylphenyl)-[1,1'-biphenyl]-4,4'-diamine) is greatly reduced under such drying conditions. On the other hand, under drying conditions of below about 110° C., the overcoat adhesion to the charge transport layer was good, but the overcoat had a high rate of wear. Thus, there was an unacceptably small drying conditions window for the overcoat to achieve the targets of both adhesion and wear rate.

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 6,004,709 discloses an allyloxypolyamide composition, the allyloxypolyamide being represented by a specific formula. The allyloxypolyamide may be synthesized by reacting an alcohol soluble polyamide with formaldehyde and an allylalcohol. The allyloxypolyamide may be crosslinked by a process selected from the group consisting of (a) heating an allyloxypolyamide in the presence of a free radical catalyst, and (b) hydrosilation of the double bond of the allyloxy group of the allyloxypolyamide with a silicon hydride reactant having at least two reactive sites. A preferred article comprises a substrate, at lest one photoconductive layer, and an overcoat layer comprising a hole transporting hydroxy arylamine compound having at least two hydroxy functional groups, and a crosslinked allyloxypolyamide film-forming binder. A stabilizer may be added to the overcoat.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispensed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 5,709,974 discloses an electrophotographic imaging member including a charge generating layer, a charge transport layer and an overcoating layer, transport layer including a charge transporting aromatic diamine molecule in a polystyrene matrix and the overcoating layer including a hole transporting hydroxy arylamine compound having at least two hydroxy functional groups and a polyamide film-forming binder capable of forming hydrogen bonds with the hydroxy functional groups of the hydroxy arylamine compound. This imaging member is utilized in an imaging process.

U.S. Pat. No. 5,368,967 discloses an electrophotographic imaging member comprising a substrate, a charge generating layer, a change transport layer, and an overcoat layer comprising a small molecule hole transporting arylamine having at least two hydroxy functional groups, a hydroxy or multihydroxy triphenyl methane and a polyamide film-forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane are disclosed in this patent.

U.S. Pat. No. 4,871,634 discloses an electrophotographic imaging member which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,457,994 discloses a layered photosensitive member comprising a generator layer and a transport layer containing a diamine type molecule dispersed in a polymeric binder and an overcoat containing triphenyl methane molecules dispersed in a polymeric binder.

U.S. Pat. No. 4,281,054 discloses an imaging member comprising a substrate, an injecting contact or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase an a chemical stabilizer selected from the group consisting of certain nitrone, isobenzofuran, hydroxyaromatic compounds and mixtures thereof. An electrophotographic imaging process using this member is also described.

U.S. Pat. No. 5,418,107 discloses a process for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film-forming polymer consisting essentially of a film-forming polymer having a polyvinyl butylral content between about 50 and about 75 mol percent, a polyvinyl alcohol content between about 12 and about 50 mol percent, and a polyvinyl acetate content between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

The discloses of each of the foregoing patents are hereby incorporated by reference herein in their entireties. The appropriate components and process aspects of each of the foregoing patents may also be selected for the present compositions and processes in embodiments thereof.

BACKGROUND

Electrophotographic imaging members, or photoreceptors, typically include a photoconductive layer formed on an electrically conductive substrate. The photoconductive layer is an insulator in the dark so that electric charges are retained on its surface. Upon exposure to light, the charge is dissipated.

Many advanced imaging systems are based on the use of small diameter photoreceptor drums. The use of small diameter drums places a premium on photoreceptor life. A major factor limiting photoreceptor life in copiers and printers is wear. The use of small diameter drum photoreceptors exacerbates the wear problem because, for example, three to ten revolutions are required to image a single letter-size page. Multiple revolutions of a small diameter drum photoreceptor to reproduce a single letter-size page can require up to one million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging damages the photoreceptor, resulting in rapid wear of the imaging surface, e.g., the exposed surface of the charge transport layer. For example, wear rates can be as high as about 16 microns per 100,000 imaging cycles. Similar problems are encountered with bias transfer roll (BTR) systems. One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, and avoidance of perturbation of underlying layers during coating.

Robust overcoat layers are being designed for long life photoreceptor application that meet required electrical properties, exhibit improved crack and scratch resistance, deletion resistance, and provide excellent print quality. The robust nature of these overcoat layer designs is primarily attributed to extensive crosslinking catalyzed by a strong acid. Although the strong acid enables short curing times, it reduces solution shelf life and therefore restricts coating production. Previous overcoat layer formulations have used pyridine as a masking agent to inhibit the acid catalyst until the catalytic function is desired. Such formulations have exhibited improved solution shelf life and adequate electrical characteristics. However, pyridine is a highly toxic compound. There remains a need for a masking agent that will extend solution shelf life and exhibit excellent electrical characteristics, while meeting environmental health and safety standards.

SUMMARY

This disclosure addresses some or all of the above problems, and others, by providing improved photoreceptor overcoat layers that include an acid catalyst masked with a novel masking agent. In one embodiment, the masking agent is a derivative of vitamin B3 that is commonly used in feed additives and pharmaceuticals. Overcoat layer solutions that include the masking agent have improved shelf life, while photoreceptors incorporating the improved overcoat layer exhibit excellent electrical characteristics.

In an embodiment, the present disclosure provides a coating composition, comprising a polymer resin composition containing at least an acid catalyst and a masking agent, wherein the masking agent is selected from the group consisting of compound A and compound B.

Compound A is given by the structural formula (I):

(I)

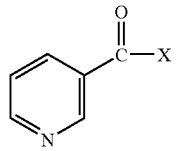

where X represent a substituent selected from the group consisting of —OR and —NR'R", wherein R, R', and R" each independently represent a hydrogen atom or a hydrocarbyl group.

Compound B is given by the structural formula (II):

(II)

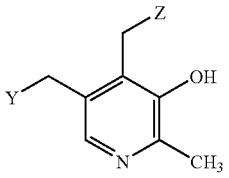

where Y and Z independently represent —OH or —$NH_2$.

The present disclosure as provides imaging members having a layer comprising a film formed from such a coating composition.

Additionally, the present disclosure also provides electrographic image development devices comprising such electrophotographic imaging members. Also provided are imaging processes using such electrographic imaging members.

In another embodiment, the present disclosure provides a process for forming an electrophotographic imaging member comprising providing an electrophotographic imaging member comprising a substrate, a charge generating layer, and a charge transport layer; forming thereover an overcoat layer comprising a polymer resin composition comprising a charge transport component, a curing agent, a polymer binder, an acid catalyst, and a masking agent, wherein the masking agent is selected from the group consisting of compound A and compound B; and curing the overcoat layer by heating.

Compound A is given by the structural formula (I):

(I)

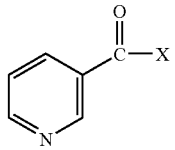

where X represents a substituent selected from the group consisting of —OR and —NR'R", wherein R, R', and R" each independently represent a hydrogen atom or a hydrocarbyl group.

Compound B is given by the structural formula (II):

(II)

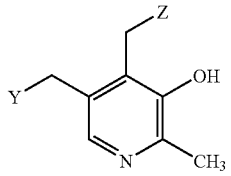

where Y and Z independently represent —OH or —$NH_2$.

Embodiments

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. Various resins may be employed as electrically non-conducting materials including polyesters, polycarbonates, polyamides, polyurethanes, and the like, which are flexible as thin webs. An electrically conducting substrate may be any metal, for example, aluminum, nickel, steel, copper, and the like, or a polymeric material, as described above, filled with an electrically conducting substance, such as carbon, metallic powder, an the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness of, for example, about 250 micrometers, or of minimum thickness of less than 50 micrometers, provided there are no adverse effects on the final electrophotographic device.

In embodiments where the substrate layer is not conductive, the surface thereof may be rendered electrically conductive by an electrically conductive coating. The conductive coating may very in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms, for an optimum combination of electrical conductivity, flexibility, and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the art may be utilized. Typical adhesive layer materials include, for example, polyesters, polyurethanes, and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating. Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer, or substrate. The electrophotographic imaging layer may be a single layer that performs both charge generating and charge transport functions as is known in the art or it may comprise multiple layers such as a charge generator layer and charge transport layer. Charge generator layers may comprise amorphous films of selenium and alloys of selenium and arsenic, tellurium, germanium, and the like, hydrogenated amorphous silicon, and compounds of silicon and germanium, carbon, oxygen, nitrogen, and the like, fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like, dispersed in a film-forming polymeric binder and fabricated by solvent coating techniques.

Phthalocyanines have been employed as photogenerating materials for use in laser printers utilizing infrared exposure systems. Infrared sensitivity is required for photoreceptors exposed to low-coast semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper hydroxygallium phthalocyanine magnesium phthalocyanine and metal-free phthalocyanine. The phthalocyanines exist in many crystal forms, which have a strong influence on photogenertion.

Any suitable polymeric film-forming binder material may be employed as the matrix in the charge generating (photogenerating) binder layer. Typical polymeric film-forming materials include those described, for example, in U.S. Pat. No. 3,121,006, the entire disclosure of which is incorporated herein by reference. Thus, typical organic polymeric film-forming binders include thermoplastic and thermosetting resins such as polycarbonates, polyesters, polyamides, polyurethanes, polystyrenes, polyarylethers, polyarylsulfones, polybutadiens, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random, or alternating copolymers.

The photogenerating composition or pigment is present in the resinous binder composition in various amounts. Generally, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also be fabricated by vacuum sublimation, in which case there is no binder.

Any suitable and conventional technique may be utilized to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removal of the solvent of a solvent coated layer may be effected by any suitable conventional technique such as oven drying, infrared radiation drying, air drying, and the like.

The charge transport layer may comprise a charge transporting small molecule dissolved or molecularly dispersed in a film-forming electrically inert polymer such a as a polycarbonate. The term "dissolved" as employed herein is defined herein as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes, and the like. As indicated above, suitable electrically active small molecule charge transporting compounds are dissolved or molecularly dispersed in electrically inactive polymeric film-forming materials. A small molecule charge transporting compound that permits injection of holes from the pigment into the charge generating layer with high efficiency and transports them across the charge transport layer with very short transit times may be N,N'-diphenyl-N,N'-bis(3-methylphenyl)-(1,1'-biphenyl)-4,4'-diamine or N,N,N',N'-tetra-p-tolylbiphenyl-4,4'-diamine. If desired, the charge transport material in the charge transport layer may comprise a polymeric charge transport material or a combination of a small molecule charge transport material and a polymeric charge transport material.

Any suitable electrically inactive resin binder that is insoluble in the alcohol solvent used to apply the overcoat layer may be employed in the charge transport layer. Typical inactive resin binders include polycarbonate resin, polyester polyarylate, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate), poly(4,4'-cyclohexylidine-diphenylene) carbonate (referred to as bisphenol-Z polycarbonate), poly(4,4'-isopropylidene-3,3'-dimethyl-diphenyl) carbonate (also referred to as bisphenol-C-polycarbonate), and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying, and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is desirably maintained from about 2:1 to 200:1 and in some instances as great as 400:1. The charge transport layer is substantially non-absorbing to visible light or radiation in the region of intended use but is electrically "active" in that it allows the injection of photogenerated holes from the photoconductive layer (i.e., charge generation layer), and allows these holes to be transported through itself to selectively discharge a surface charge on the surface of the active layer.

To improve photoreceptor wear resistance, a protective overcoat layer is provided over the charge transport layer. The overcoat layer generally includes a film-forming resin composition, such as a film-forming composition comprising at least a melamine compound, a polyol, and a hole transporting molecule. The overcoating layer can be formed, for example, from a solution or other suitable mixture of the film-forming resin composition, and other optional additives. For example, the overcoating layer can be formed from a solution comprising the film-forming resin composition of at least a melamine compound or resin, a polyol, and a charge transport compound in a solvent. In embodiments, the film-forming resin composition can include from about 5 to about 80 percent by weight of charge transport compound, from about 5 to about 90 percent by weight of polyol polymer, from about 70 to about 5 percent by weight of melamine compound, and from about 5 to about 60 percent by weight of curing agent, although other amounts and other components can be used. Other examples of these overcoat layers are described in U.S. Patent Application Publication No. 2006/0105264.

A polyol is generally defined as a compound or polymer containing multiple pendent hydroxyl groups. Examples of such polyol polymers include an aliphatic polyester polyol, an aromatic polyester polyol, an acrylated polyol, an aliphatic polyester polyol, an aromatic polyether polyol, a (polystyrene-co-polyacrylate) polyol, polyvinyl butylral, poly(2-hydroxyethyl methacrylate), and the like. For example, in embodiments, the polyol polymer can be a polyester polyol or acrylated polyol, such as a highly branched polyester polyol or acrylated polyol. The term "highly branched" refers, for example, to a prepolymer synthesized using a significant amount of trifunctional alcohols, such as triols, to form a polymer having a significant number of branches off of the main polymer chain. This is distinguished from a linear prepolymer that contains only difunctional monomers, and thus little or no branches off of the main polymer chain. The term "polyester polyol" refers, for example, to such compounds that include multiple ester groups as well as multiple alcohol (hydroxyl) groups in the molecule, and which can include other groups such as, for example, ether groups and the like. In embodiments, the polyester polyol can thus include ether groups or can be free of ether groups. Likewise, the term"acrylated polyol" refers, for example, to such compounds that include multiple ether groups as well as multiple alcohol (hydroxyl) groups in the molecule, and which can include acrylate groups such as, for example, methacrylate groups and the like. Examples of polyols include, but are not limited to, Desmophen-800 from Bayer, 7558-B60 from OPC Polymers, or Joncryl-587 and -510 from Johnson Polymers.

In embodiments, the overcoating layer may contain any suitable film-forming resin, including any of those described above for use in the other layers of the imaging member. In these embodiments, the film-forming resin can be electrically insulating, semi-conductive, or conductive, and can be hole transporting or not hole transporting. Thus, for example, suitable film-forming resins can be selected from thermoplastic and thermosetting resins such as polycarbonates, polyesters, polyamides, polyurethanes, polystyrenes, polyarylethers, polyarylsulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrene and acrylonitrile copolymers, vinyl acetate copolymers, acrylate copolymers, alkyd resins, styrenebutadiene copolymers, styrene-alkyd resins, polyvinylcarbazole, and the like. These polymers may be block, random, or alternating copolymers.

In forming the binder material for the overcoating layer, any suitable crosslinking agents, catalysts, and the like can be included in known amounts for known purposes. For example, in embodiments, a crosslinking agent or accelerator, such as a melamine crosslinking agent or accelerator, can be included with the polyester polyol or acrylated polyol for forming the overcoating layer. Incorporation of a crosslinking agent or accelerator provides reaction sites to interact with the polyester polyol or acrylated polyol, to provide a branched, crosslinked structure. When so incorporated, any suitable crosslinking agent or accelerator can be used, including, for example, trioxane, melamine compounds, and mixtures thereof.

Where melamine compounds or resins are used in the overcoating layer, any suitable melamine compound can be used. The melamine compounds can be suitably functionalized to be, for example, melamine formaldehyde, acrylated melamine-formaldehyde compounds or resins, such as where the alky group has from about one to about ten or from one to about four carbon atoms, methoxymethylated melamine compounds, such as glycouril-formaldehyde and benzoguanamine-formaldehyde, and the like. An example of a suitable methoxymethylated melamine compound is Cymel 303 (available from Cytec Industries), which is a methoxymethylated melamine compound with the formula $(CH_3OCH_2)_6N_3C_3N_3$ and the following structure:

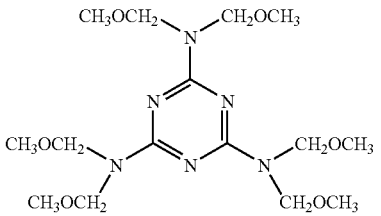

Typical melamine resins include poly(melamine-formaldehyde), acrylated poly(melamine-formaldehyde) such as methylated poly(melamine-formaldehyde), methylated/butylated poly(melamine-formaldehyde), and the like.

Crosslinking is generally accomplished by heating in the presence of a catalyst. Thus, the solution of the film-forming composition can also include a suitable catalyst. Any suitable catalyst may be employed. Typical catalysts include, for example, oxalic acid, maleic acid, carbollylic acid, asorbic acid, malonic acid, succinic acid, tartaric acid, citric acid, methanesulfonic acid, and the like, and mixtures thereof. The acid catalyst may be an organic sulfonic acid having from 1 to about 30 carbon atoms, such as toluenesulfonic acids, including p-toluenesulfonic acid.

In embodiments, the overcoat layer comprises a masking agent. A masking agent can be used to "tie up" or block the acid effect of the catalyst to provide solution stability until the acid catalyst function is desired. Thus, for example, the masking agent can block the acid effect until the solution temperature is raised above a threshold temperature. For example, some masking agents can be used to block the acid effect until the solution temperature is raised above about 100° C. At that time, the masking agent dissociates from the acid and vaporizes. The unassociated acid is then free to catalyze the polymerization. Some or all of the masking agent may remain in the cured layer or be vaporized.

Previous overcoat layer formulations have used pyridine as a masking agent. However, recent studies suggest that some pyridines have environmental concerns. The permissible exposure limit (PEL) and the threshold limit value (TLV) of pyridine, as set by OSHA, are both 5 ppm. Prolonged exposure to pyridine in some cases can cause cumulative liver, kidney, and bone marrow damage, and may adversely affect the central nervous system. See http://www.osha.gov/dts/chemiclsampling/data/CH_265300.html.

In one embodiment, methyl nicotinate, a derivative of vitamin B3, provides surprising results when used as a masking agent in an overcoat layer solution. The overcoat layer solution exhibits improved shelf life over overcoat layer solutions without a masking agent. Additionally, photoreceptors incorporating an overcoat layer utilizing methyl nicotinate as a masking agent demonstrate excellent electrical characteristics. Moreover, methyl nicotinate is considered safe for human and animal consumption, as it is commonly used in feed additives and pharmaceuticals. Methyl nicotinate is commercially available from, for example, Sigma-Aldrich, and has the following structure:

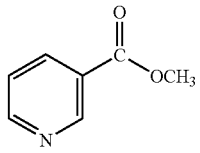

In other embodiments, it is also suitable to use as a masking agent any of a number of derivatives of methyl nicotinate, as represented by the following structure:

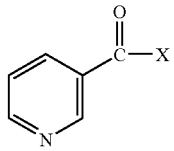

wherein X represent a substituted selected from the group consisting of —OR and —NR'R", where R, R', and R" each independently represent a hydrogen atom or a hydrocarbyl group. The hydrocarbyl group can be, for example, a substituted or unsubstituted, a straight or branched alkyl, alkenyl, or alkynyl group having from 1 to about 20 carbon atoms, such as from 1 to about 10 or 1 to about 6 carbon atoms. In examples, X represents an —OR group where R is an alkyl group having from 1 to about 6 carbon atoms.

In other embodiments, the making agent may be selected from a group of compounds represented by the following structure:

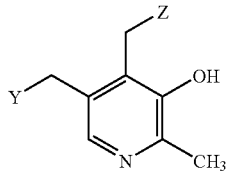

where Y and Z independently represent —OH or —$NH_2$. The masking agent may also be an acylated derivative of these compounds.

Specific suitable masking agents include methyl nicotinate, pyridoxamine, pyridoxine, Niacin, and the acyl derivatives of pyridoxamine and pyridoxine, although other compounds can also be used.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking can be beneficial for flexible photoreceptors having, for example, web or belt configurations. The degree of crosslinking can be controlled by the relative amount of catalyst employed. The amount of catalyst needed to achieve a desired degree of crosslinking will vary depending upon the specific coating solution materials, such as polyol, catalyst, temperature and time used for the reaction. In embodiments, the polyol is crosslinked at a temperature of about 100° C. to about 150° C. A typical crosslinking temperature used for polyols with p-toluenesulfonic acid as a catalyst is less than about 140° C. for about 40 minutes. A typical concentration of acid catalyst is about 0.01 to about 5.0 weight percent based on the weigh of polyol. At least one equivalent of masking agents is needed to sufficiently mask the acid catalyst. After crosslinking, the overcoating should be substantially insoluble in the solvent in which it was soluble prior to crosslinking. Thus, no overcoating material will be removed when rubbed with a cloth soaked in the solvent. Crosslinking results in the development of a three-dimensional network that restrains the transport molecule in the crosslinked polymer network.

Any suitable alcohol solvent may be employed for the film-forming polymers. Typical alcohol solvents include, for example, butanol, propanol, methanol, 1-methoxy-2-propanol, and the like, and mixtures thereof. Other suitable solvents that tetrahydrofuran, monochlorobenzene, and mixtures thereof. These solvents can be used in addition to, or in place of, the above alcohol solvents, or they can be omitted entirely. However, in some embodiments, higher boiling alcohol solvents are avoided, as they can interfere with the desired cross-linking reaction.

Any suitable hole transport material may be utilized in the overcoating layer. However, to provide one or more desired benefits including resistance to cracking, desired mechanical properties, resistance to image deletion, and the like, embodiments include a hydroxyl-containing hole transport compound as a hole transporting molecule.

Exemplary hydroxyl-containing hole transport compounds include those of the following formula:

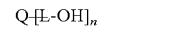

wherein Q represent a charge transport component, L represents a divalent linkage group, and n represents a number of repeating segments or groups such a from 1 to about 8.

Any suitable charge transport compound can be used as the moiety Q. For example, suitable charge transport compounds include amines, such as tertiary arylamines, pyrazolines, hydrazones, oxaliazoles, stilbenes, and mixtures thereof.

More specifically, in embodiments, Q is represented by the following general formula

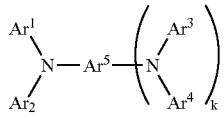

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least one of $Ar^1$, $Ar^2$, $Ar^3$ and $Ar^4$ is connected to the linkage group L.

For example, in embodiments, $Ar^1$, $Ar^2$, $Ar^3$, $Ar^4$ and $Ar^5$ each independently represents a substituted or unsubstituted aryl group, such as

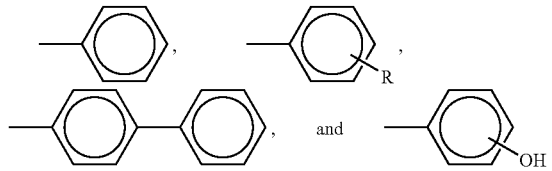

where R is selected from the group consisting of an alkyl group having 1 to about 10 carbon atoms, such as —$CH_3$, —$C_2H_5$, —$C_3H_7$, and —$C_4H_9$, or $Ar^5$ independently represents a substituted or unsubstituted arylene group, such as

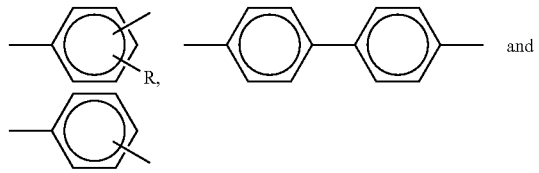

where R is selected from the group consisting of an alkyl group having 1 to about 10 carbon atoms, such as —$CH_3$, —$C_2H_5$, —$C_3H_7$, and —$C_4H_9$. Other suitable groups for $Ar^5$, when k is grater than 0, include:

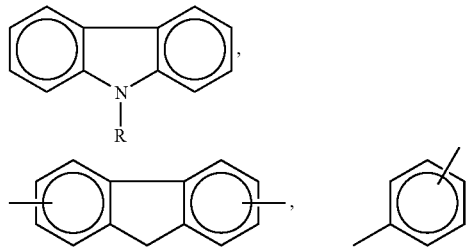

-continued
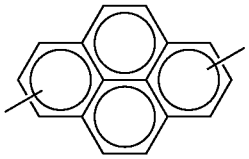
and
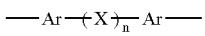
where n is 0 or 1, Ar is any of the group defied above for $Ar^1$, $Ar^2$, $Ar^3$, $Ar^4$ and $Ar^5$, and X is selected from the group consisting of:
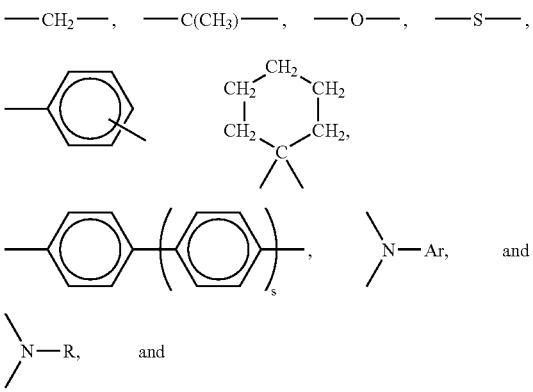
where s is 0, 1 or 2.
In embodiments, more specifically, Q is a compound selected from the following:
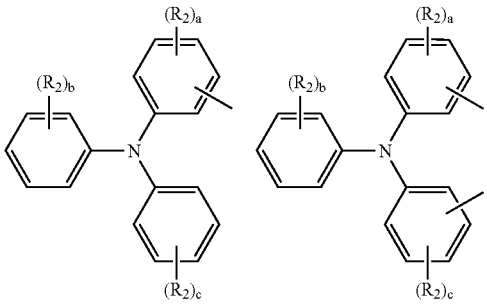
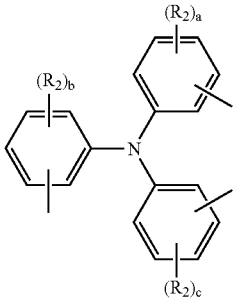
-continued
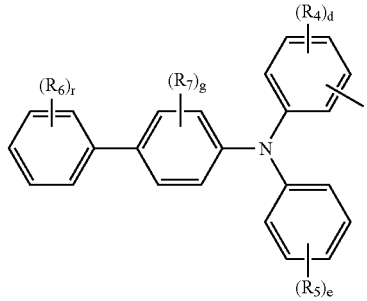
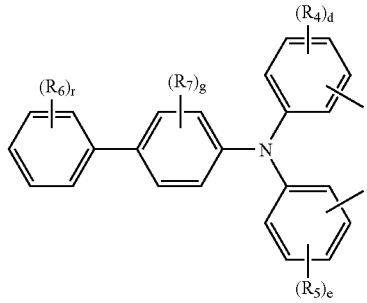
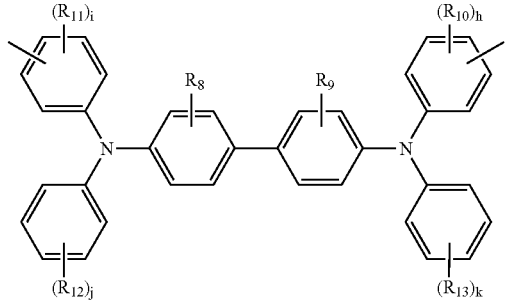
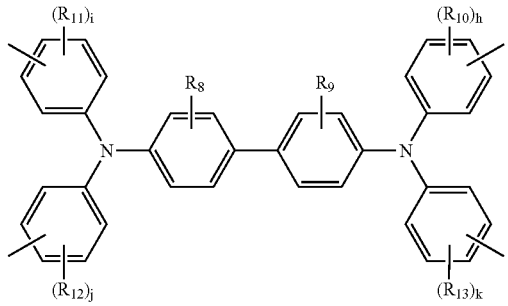
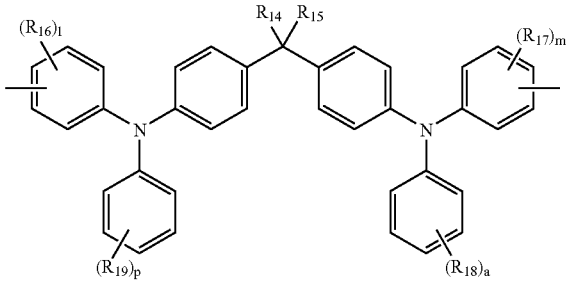

-continued

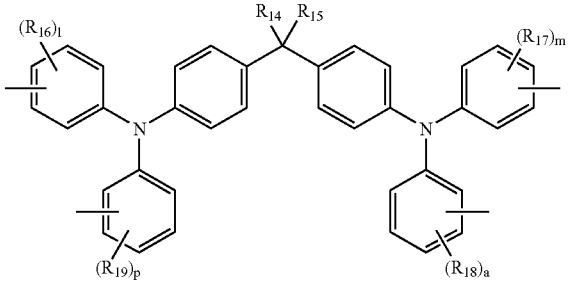

and mixtures thereof, wherein $R_1$ to $R_{19}$ are independently selected from the group comprised of a hydrogen atom, an alkyl such as having from 1 to about 20 carbon atoms, a cyclic alkyl such as having from 4 to about 20 carbon atoms, an alkoxyl group such as having from 1 to about 20 carbon atoms, and halogen, and subscripts a to p each independently represents an integer of 1 or 2. In other embodiments, the charge transport compound Q is selected from the following:

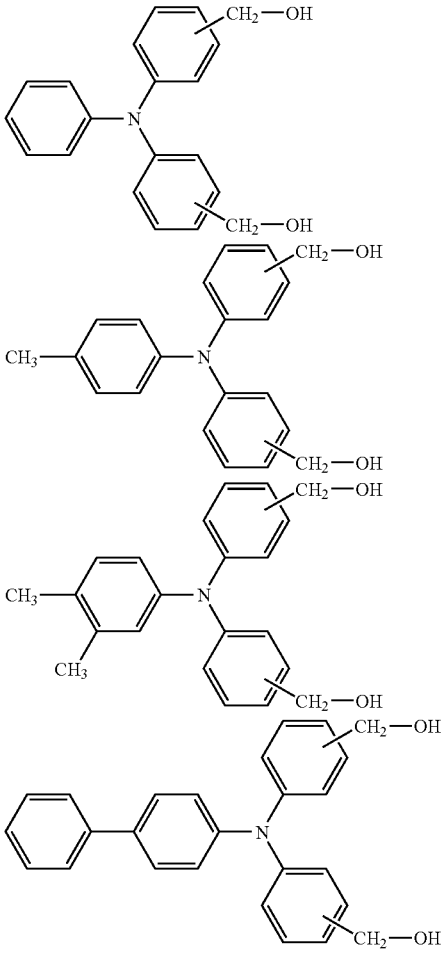

and mixtures thereof.

In the above exemplary hydroxyl-containing hole transport compound, L represents a divalent linkage group. In embodiments, the divalent linkage L can be a divalent hydrocarbyl group such as containing from 1 to about 20 carbon atoms or from 1 to about 15 carbon atoms, optionally further containing a heteroatom such as oxygen, sulfur, silicon, and nitrogen. Specific examples of suitable divalent linkage groups L include alkyl groups —(—$CH_2$)$_y$—, where y is an integer from 1 to about 15 or from 1 to about 10, such as methylene or ethylene,

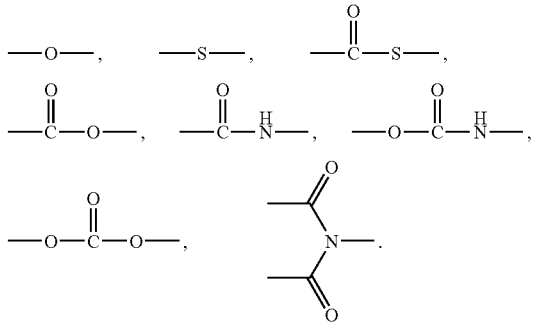

and combination thereof.

In the above exemplary hydroxyl-containing hole transport compound, n represents an integer of 1 to about 8. In embodiments, n is 1 to about 3 or 1 to about 4, such as 1, 2, 3, or 4. For example, when n=2, the compound is represented as a dihydroxyalkyl arylamine compound hole transporting molecule.

If desired, the hydroxyl-containing hole transport compound, such as a hydroxyalkyl arylamine, can be used combinations of two or more, such as two, three, four or more different hydroxyl-containing hole transport compounds, or one or more hydroxyl-containing hole transport compounds can be used in combination with one or more other types of hole transporting molecules.

Typically hydroxyl-containing hole transport compounds can be readily prepared by known processes. For example, the exemplary compound N,N-bis(4-hydroxymethylphenyl)-3,4-dimethylphenylamine can be prepared from a halogenated dimethylbenzene and a diphenylamine according to the following reaction scheme:

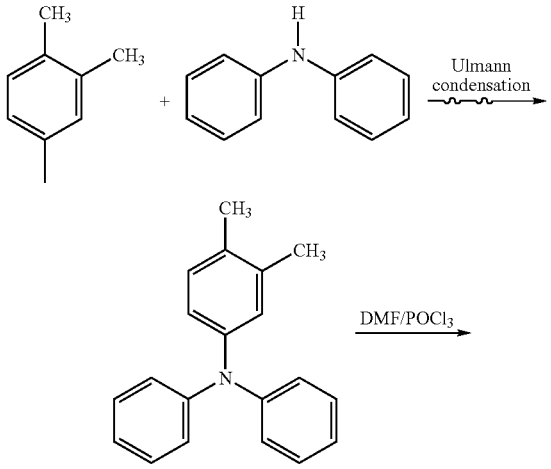

-continued

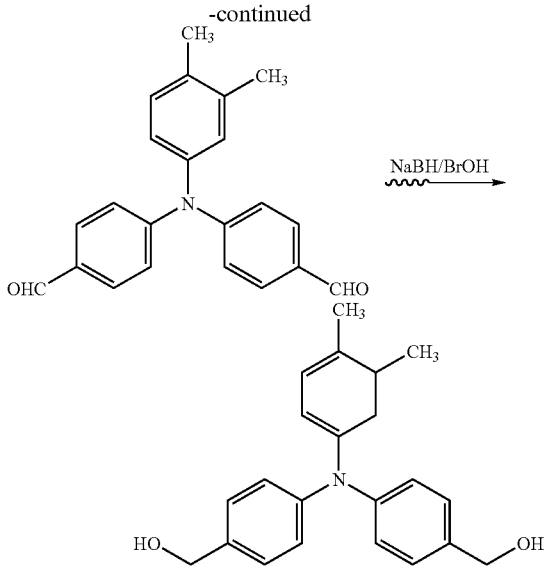

N,N-bisphenyl-3,4-dimethylphenylamine can be prepared by known Ulmann condensation process. The bisformalation of N,N-bisphenyl-3,4-dimethylphenylamine affords the bisformalated arylamine intermediate. Reduction of the aldehydes leads to the final product, N,N-bis(4-hydroxymethylphenyl)-3,4-dimethylphenylamine. Other hydroxyl-containing hole transport compounds can be readily made by modification of the above reaction scheme.

The thickness of the continuous overcoat layer selected depends upon the abrasiveness of the charging (such as bias charging roll), cleaning (such as blade or web), development (such as brush), transfer (such as bias transfer roll), and the like in the system employed and can range from about 1 or about 2 microns up to about 10 or about 15 microns or more. A thickness of about 1 micrometer to about 5 micrometers is desired, in embodiments. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating of this disclosure should transport holes during imaging and should not have too high of a free carrier concentration. Free carrier concentration in the overcoat increases the dark decay. In embodiments, the dark decay of the overcoat layer should be about the same as that of devices without an overcoat layer.

In the dried overcoat layer, the composition can include from about 10 to about 90 percent by weight film-forming binder, and from about 90 to about 10 percent by weight hole transporting molecule. For example, in embodiments, the hole transporting molecule can be incorporated into the overcoating layer in an amount of from about 20 to about 70 percent by weight, such as about 33 percent by weight. As desired, the overcoating layer can also include other materials, such as conductive fillers, abrasion resistant fillers, and the like, in any suitable and known amounts.

Advantages provided by the percent disclosure include, in embodiments, robust overcoating layers that provide desirable electrical and mechanical properties, that can be manufactured within environmental and health safety standards. In embodiments, the overcoat layer exhibits excellent resistance to abrasion, resistance to scratching and cracking without adversely affecting the electrical performance of photoreceptors. Therefore, the coated photoreceptor devices demonstrate extended service life while maintaining desirable image quality.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697, and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

Examples are set forth below and are illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

An overcoat layer solution was prepared by mixing a solution of methyl nicotinate and aid catalyst (p-toluenesulfonic acid) with methoxymethyl butoxymethyl melamine, a phenolic resin, and a hole transport molecule in an alcohol solvent. The resulting overcoat layer solution was analyzed by Gel Permeation Chromatography immediately after preparation, and then later accelerated aging at 40° C. for 16 hours. The percentage of oligomer content in the solution was calculated and is shown in Table 1.

Comparative Example 1

An overcoat layer solution was prepared as in Example 1, except the masking agent, methyl nicotate was omitted. The resulting overcoat layer solution was analyzed by Gel Permeation Chromatography immediately after preparation, and then after accelerated aging at 40° C. for 16 hours. The percentage of oligomer content in the solution was calculated and is shown in Table 1.

TABLE 1

Effect of Blocked and Unblocked Acid Catalyst on Oligomer Formation in Overcoat Layer Solutions

| | Oligomer Content Fresh Solution | Oligomer Content Solution Aged 16 hrs @ 40° C. |
|---|---|---|
| Blocked Catalyst | 13% | 37% |
| Unblocked Catalyst | 46% | 73% |

Example 2

An overcoat layer solution was prepared as in Example 1. The overcoat layer solution was coated on a photoreceptor device and cured at 125° C. for 2 min. The electrical characteristics of the photoreceptor were then analyzed. The results are shown in Table 2. From the results, it is clear that including methyl nicotinate does not adversely affect the electrical characteristics of the device as evident by the small change in Vr and at the same time, increases the shelf life stability.

Example 3

An overcoat layer solution was prepared as in Example 1. The overcoat layer solution was aged for 10 days, and was then coated on a photoreceptor device and cured at 125° C. for 2 min. The electrical characteristics of the photoreceptor were then analyzed. The results are shown in Table 2.

TABLE 2

Time Zero Electrical Characteristics

| | Total Thickness (CTL + OC) (microns) | Vcor (−V) | Vddp (−V) | Dark Decay (500 ms) (V) | S (V · erg/cm$^2$) | $E_{1/2}$ (ergs/cm$^2$) | $E_{7/8}$ (ergs/cm$^2$) | Vr |
|---|---|---|---|---|---|---|---|---|
| Example 2 (no aging) | 31.30 | 5025.00 | 816.24 | 20.62 | 375.81 | 1.25 | 3.13 | 19.77 |
| Example 3 (aged 10 days) | 31.50 | 4970.00 | 814.57 | 19.06 | 355.93 | 1.31 | 3.59 | 28.19 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A coating composition, comprising:

a polymer resin composition containing at least:

a melamine compound;

a polyol compound;

an acid catalyst; and a masking agent selected from the group consisting of compound A, compound B, and acylated derivatives of compound A;

wherein:

compound A is given by structural formula (I):

(I)

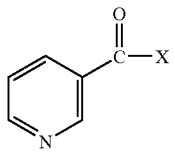

wherein X represents a substituent selected from the group consisting of —OR and —NR'R", wherein R, R', and R" each independently represents a hydrogen atom or a hydrocarbyl group; and compound B is given by the structural formula (II):

(II)

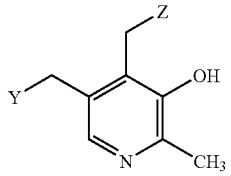

wherein Y and Z independently represent —OH or —$NH_2$.

2. The coating composition according to claim 1, wherein the masking agent is compound A.

3. The coating composition according to claim 2, wherein the hydrocarbyl group is a substituted or unsubstituted, a straight or branched alkyl, alkenyl, or alkynyl group having from 1 to about 20 carbon atoms.

4. The coating composition according to claim 2, wherein X represents an —OR group, where R represents an alkyl group having from 1 to about 6 carbon atoms.

5. The coating composition according to claim 1, wherein the masking agent is compound B.

6. The coating composition according to claim 5, wherein Y and Z each represent an —OH group.

7. The coating composition according to claim 1, wherein the masking agent is selected from the group consisting of pyridoxamine, pyridoxine, Niacin, and acyl derivatives of pyridoxamine and pyridoxine.

8. The coating composition according to claim 1, wherein the masking agent is methyl nicotinate.

9. The coating composition according to claim 1, wherein the acid catalyst is an organic sulfonic acid having from 1 to about 30 carbon atoms.

10. The coating composition according to claim 9, wherein the sulfonic acid is a toluenesulfonic acid.

11. The coating composition according to claim 1, wherein the polyol is selected from the group consisting of an aliphatic polyester polyol, an aromatic polyester polyol, an acrylated polyol, an aliphatic polyether polyol, an aromatic polyether polyol, a polyurethane polyol, a (polystyrene-co-polyacylate) polyol, polyvinylbutylral, and poly(2-hydroxyethyl methacrylate).

12. An imaging member, comprising:

a layer comprising a film formed from the coating composition of claim 1.

13. An imaging member according to claim 12, wherein the coating composition further comprises a charge transport component selected from the group consisting of a tertiary arylamine, pyrazoline, hydrazone, oxaliazole, and stilbene.

14. An imaging member according to claim 12, wherein the coating composition is thermally cross-linked or cured.

15. An electrophotographic imaging member, comprising:

a substrate;

a charge generating layer;

a charge transport layer; and an overcoat layer, the overcoat layer comprising a film formed from a polymer resin composition containing at least a charge transport component, a curing agent, a polymer binder, an acid catalyst, and a masking agent, wherein the masking agent is selected from the group consisting of compound A, compound B, and the acylated derivatives of compound A;

wherein:

compound A is given by the structural formula (I):

(I)

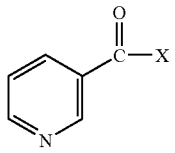

wherein X represents a substituent selected from the group consisting of —OR and —NR'R", wherein R, R', and R" each independently represent a hydrogen atom or a hydrocarbyl group; and compound B is given by the structural formula (II):

(II)

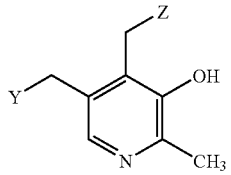

wherein Y and Z independently represent —OH or —$NH_2$.

16. The imaging member according to claim 15, wherein the charge transport component is represented by the following general formula:

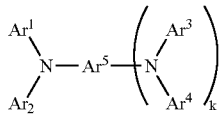

wherein:

$Ar^1$, $Ar^2$, $Ar^3$, and $Ar^4$ are each independently a substituted or unsubstituted aryl group having from 1 to about 25 carbon atoms;

$Ar^5$ is a substituted or unsubstituted aryl or arylene group having from 1 to about 25 carbon atoms, and k is 0 or 1;

wherein $Ar^1$, $Ar^2$, and $Ar^3$ independently include a substituent selected from the group consisting of a hydroxyl, a hydroxymethyl, and an alkoxymethyl having from about 2 to about 15 carbons.

17. The imaging member according to claim 15, wherein the charge transport component is selected from the group consisting of the following structural formulas:

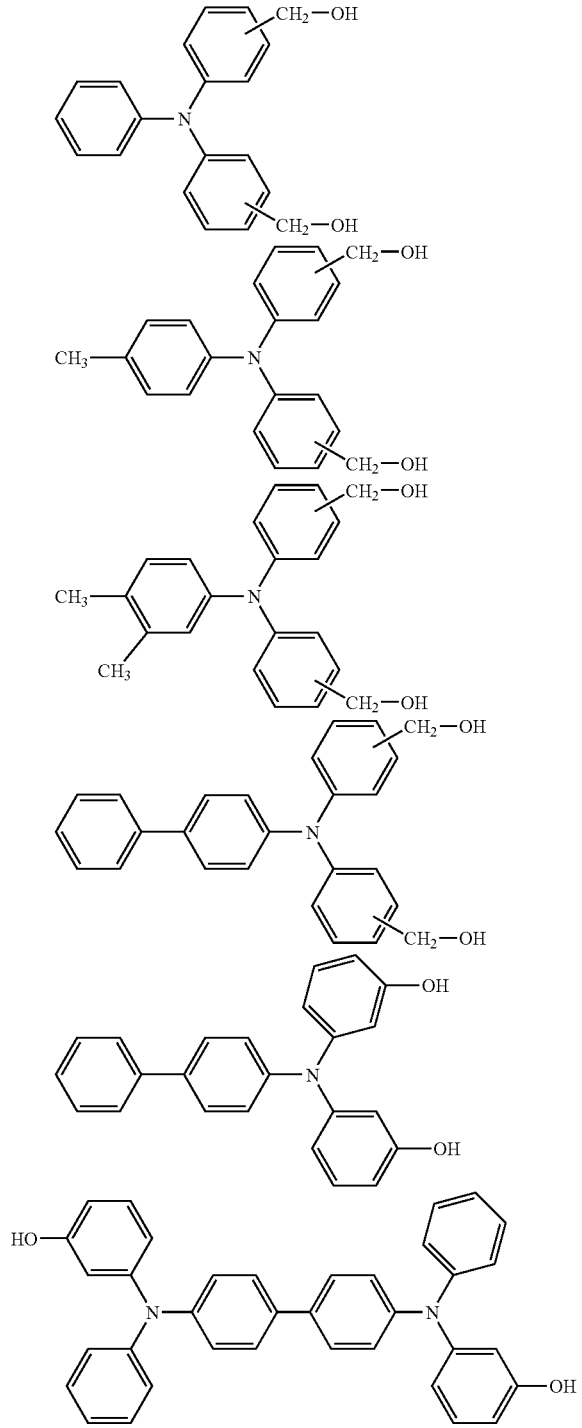

and mixtures thereof.

18. The imaging member according to claim 15, wherein the charge transport layer comprises N,N'-diphenyl-N,N'-bis(3 -methylphenyl)-(1,1'-biphenyl)-4,4'-diamine or N,N,N',N'-tetra-p-tolylbiphenyl-4,4'-diamine.

19. The imaging member according to claim 15, wherein the curing agent is selected from the group consisting of a melamine-formaldehyde resin, a phenol-formaldehyde resin, and a melamine-phenol-formaldehyde resin.

20. The imaging member according to claim 15, wherein the polymer binder is a polyol selected from the group consisting of a polyester polyol, an acrylated polyol, and an aliphatic polyether polyol.

21. The imaging member according to claim 15, wherein the acid catalyst is an organic sulfonic acid having from 1 to about 30 carbons.

22. The imaging member according to claim 15, wherein the masking agent is methyl nicotinate.

23. The imaging member according to claim 16, wherein the resin composition comprises:

from about 30 to about 60 percent by weight of the charge transport component;

from about 10 to about 50 percent by weight of the curing agent;

from about 5 to about 50 percent by weight of the polymer binder;

from about 0.1 to about 5 percent by weight of acid catalyst; and at least one equivalent of masking agent.

24. The imaging member according to claim 15, wherein the overcoat layer is thermally cured.

25. A process for forming an electrophotographic imaging member comprising:

providing an electrophotographic imaging member comprising a substrate, a charge generating layer, and a charge transport layer;

forming thereover an overcoat layer comprising a film formed from a polymer resin composition comprising a charge transport component, a curing agent, a polymer binder, an acid catalyst, and a masking agent, wherein the masking agent is selected from the group consisting of compound A, compound B, and the acylated derivatives of compound A, wherein:

compound A is given by the structural formula (I):

(I)

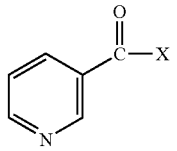

wherein X represents a substituent selected from the group consisting Of —OR and —NR'R", wherein R, R', and R" each independently represent a hydrogen atom or a hydrocarbyl group; and compound B is given by the structural formula (II):

(II)

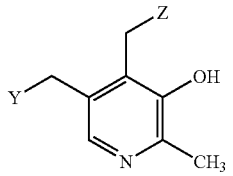

wherein Y and Z independently represent —OH or —$NH_2$; and curing the overcoat layer by heating.

26. The process according to claim 25, wherein the coating composition further comprises an alcohol solvent.

* * * * *